US008528891B2

(12) United States Patent
Aiba et al.

(10) Patent No.: US 8,528,891 B2
(45) Date of Patent: Sep. 10, 2013

(54) CREASING DEVICE AND IMAGE FORMING SYSTEM

(75) Inventors: Go Aiba, Miyagi (JP); Naoyuki Ishikawa, Kanagawa (JP); Hitoshi Hattori, Tokyo (JP); Takashi Saito, Kanagawa (JP); Shuuya Nagasako, Kanagawa (JP); Yuusuke Shibasaki, Kanagawa (JP); Akihiro Musha, Kanagawa (JP); Naohiro Kikkawa, Kanagawa (JP); Hidetoshi Kojima, Miyagi (JP); Naoki Oikawa, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/327,907

(22) Filed: Dec. 16, 2011

(65) Prior Publication Data

US 2012/0157285 A1 Jun. 21, 2012

(30) Foreign Application Priority Data

Dec. 16, 2010 (JP) ..... 2010-280689

(51) Int. Cl.
*B31F 1/08* (2006.01)

(52) U.S. Cl.
USPC ..... 270/45; 270/58.07

(58) Field of Classification Search
USPC ..... 270/32, 45, 58.07; 493/59, 355, 493/396, 397, 240, 242
See application file for complete search history.

(56) References Cited

U.S. PATENT DOCUMENTS 5,709,376 A * 1/1998 Ushirogata ..... 270/58.11
6,991,224 B2 * 1/2006 Trovinger et al. ..... 270/32
7,740,238 B2 * 6/2010 Iijima et al. ..... 270/37
7,913,988 B2 * 3/2011 Awano ..... 270/45
2010/0207314 A1 8/2010 Hattori et al.
2011/0076081 A1 3/2011 Hattori et al.
2011/0130260 A1 6/2011 Kikkawa et al.
2011/0245055 A1 10/2011 Saito et al.
2011/0301005 A1 12/2011 Hattori et al.
2011/0301008 A1 12/2011 Shibasaki et al.

FOREIGN PATENT DOCUMENTS

JP 4506836 B2 7/2009
JP 2011-256002 12/2011

OTHER PUBLICATIONS

English language abstract for patent publication JP2009-166928 which corresponds to JP-4506836-B2.

* cited by examiner

*Primary Examiner* — Leslie A Nicholson, III
(74) *Attorney, Agent, or Firm* — Harness, Dickey & Pierce, P.L.C.

(57) ABSTRACT

A creasing device includes: a first member including a creasing blade; a first receiving member including an attachment surface where the first member is to be attached; a second member arranged to face the first member and including a first creasing channel and a second creasing channel opposite to the first creasing channel, the first creasing channel configured to allow the creasing blade to be fitted thereinto with the sheet between the first creasing channel and the creasing blade, the second creasing channel configured to allow the creasing blade to be fitted thereinto with the sheet between the second creasing channel and the creasing blade; a second receiving member including an attachment surface where the second member is to be attached; and a driving section that brings the first and second members into contact with each other and separates the first member and the second member from one another.

4 Claims, 11 Drawing Sheets

CREASING DEVICE AND IMAGE FORMING SYSTEM

CROSS-REFERENCE TO RELATED APPLICATIONS

The present application claims priority to and incorporates by reference the entire contents of Japanese Patent Application No. 2010-280689 filed in Japan on Dec. 16, 2010.

BACKGROUND OF THE INVENTION

1. Field of the Invention

The present invention relates to a creasing device and to an image forming system that includes the creasing device, which, prior to folding a sheet-shaped member (hereinafter referred to as "sheet") transferred from a preceding device, previously forms a crease in the sheet, and an image forming apparatus.

2. Description of the Related Art

What is called saddle-stitched or center-folded booklet production has been conventionally performed in which a sheet batch, which is a stack of a plurality of sheets delivered from an image forming apparatus, is saddle stitched and the thus-saddle-stitched sheet batch is folded in the middle of the sheet batch. Folding such a sheet batch containing a plurality of sheets can cause an outside sheet of the sheet batch to be stretched at a fold line by a greater amount than an inside sheet. An image portion at the fold line on the outside sheet can suffer damage such as come off of toner caused by being stretched in some cases. A similar phenomenon can occur when other fold, such as z-fold or tri-fold, is performed. A sheet batch can be folded insufficiently depending on the thickness of the sheet batch.

Creasing devices, so called creaser, that, prior to a folding process where a sheet batch is folded in half or the like, previously form a crease (score) in sheets to make sheets, including also an outside sheet, easy to be folded, thereby preventing come off of toner have already been known. Such creasing devices typically form a crease in a sheet in a direction perpendicular to a direction, in which the sheet is conveyed, by moving a roller on the sheet, burning the sheet with a laser beam, pressing a creasing blade against the sheet, or a like method.

A known example of such a creasing device is disclosed in Japanese Patent Application Laid-open No. 2009-166928. Disclosed in Japanese Patent Application Laid-open No. 2009-166928 is a technique of moving a creasing member by using a plurality of individually-advancing-and-retracting mechanisms, which move the creasing member at different timings, in order to enable formation of a crease while reducing movement of pressing by the creasing member.

However, forming a crease in a sheet with a roller involves moving the roller across the length of the sheet in a direction, along which a fold line is to lie, and therefore is time consuming. To resolve this, it is conceivable to rotate a sheet conveying direction by 90 degrees and produce a crease parallel to the sheet conveying direction; thereby, time to form a crease becomes unnecessary because the crease can be formed while the sheet is conveyed; however, this scheme involves a change in footprint and therefore is disadvantageous for space-saving design. Creasing by using a laser beam is environmentally less favorable because smoke and odor are given off during creasing.

Creasing a sheet by pressing a creasing blade against the sheet can be performed in a relatively short period of time and allows easy production of a crease perpendicular to a sheet conveying direction; however, pressing a longitudinal face of the creasing blade against the sheet entirely at once can increase a load. To reduce the load, a scheme of bringing the creasing blade face into partial contact with a sheet a plurality of times can be used. However, this scheme is disadvantageous in that unevenness can develop between a portion that contacts the blade multiple times and a portion that contacts the blade only once and also in that producing a crease by making contact multiple times can decrease productivity.

To overcome the inconveniences described above, it is possible to reduce a load placed on a creasing moving unit and cause every part of the creasing blade to contact the sheet only once by bringing the creasing blade gradually into contact with a sheet from an edge of the sheet; however, this causes a pressure applied onto a center portion of the sheet to be weakened, making it difficult to form an even crease. An even crease can be formed by gradually bringing an arcuate creasing blade into contact with a sheet from an edge of the sheet. However, this requires that a channel or a projection having a complex shape be defined in or formed on a curved surface, and thus requires significant time and cost to manufacture the arcuate creasing blade and the arcuate creasing channel.

Therefore, there is a need to enable efficient and low cost manufacture of an arcuate blade that enables formation of an even crease in a sheet.

SUMMARY OF THE INVENTION

It is an object of the present invention to at least partially solve the problems in the conventional technology.

A creasing device creasing a sheet includes: a first member extending in a direction perpendicular to a direction, in which the sheet is conveyed, and including a convex blade having a convex cross section; a first receiving member including an attachment surface, to which the first member is to be attached; a second member arranged to face the first member and including a concave blade having a channel-like shape, the concave blade allowing the convex blade to be fitted thereinto with the sheet between the concave blade and the convex blade; a second receiving member including an attachment surface, to which the second member is to be attached; and a driving section that relatively brings the first member and the second member into contact with each other and separates the first member and the second member from one another to cause the sheet stopped at a predetermined position to be pinched between the first member and the second member and creased. At least any one of the attachment surface of the first receiving member and the attachment surface of the second receiving member is arcuate. When the first member is attached to the attachment surface of the first receiving member and the second member is attached to the attachment surface of the second receiving member in a manner that the first member and the second member face each other, a blade edge of at least one of the convex blade and the concave blade has an arcuate shape convex toward one another.

An image forming system includes: a creasing device that creases a sheet; and an image forming apparatus that forms an image on the sheet. The creasing device is configured as described above.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
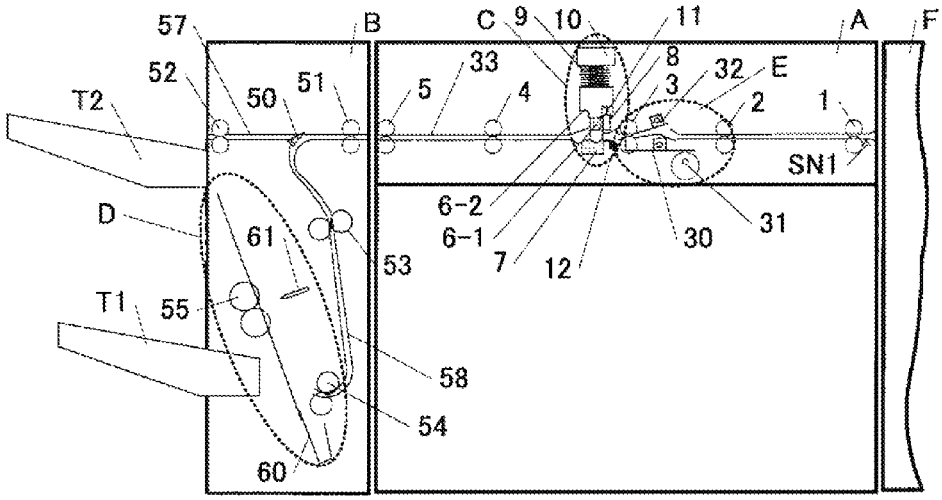
FIG. 1 is a diagram illustrating a schematic configuration of an image forming system according to an embodiment of the present invention.

According to an embodiment of the present invention, a component that has conventionally been formed as a single member is divided into two components; one of the two the components is a member serving as a convex blade or a concave blade and is formed to be straight, while the other of the two the components is a receiving member that has a surface, which receives and supports the member, formed to be arcuate; the convex blade or the concave blade is shaped arcuate by being attached to the arcuate surface.

Exemplary embodiments of the present invention are described in detail below with reference to the accompanying drawings.

In the embodiments described below, a reference symbol P denotes the sheet; a reference numeral A denotes the creasing device; a creasing blade 6-1 corresponds to the convex blade; a blade member 6-3 corresponds to a first member; a blade-side receiving member 6-2 corresponds to a first receiving member; a creasing channel 7-1 corresponds to the concave blade; a channel member 7-3 corresponds to a second member; a channel-side receiving member 7-2 corresponds to a second receiving member; a drive mechanism 40 corresponds to a driving section; a lower surface 6-4 of the blade-side receiving member 6-2 or a upper surface 7-4 of the channel-side receiving member 7-2 corresponds to an attachment surface; a reference symbol F corresponds to the image forming apparatus. The first member and the first receiving member form a creasing member 6. The second member and the second receiving member form a receiving block 7.

FIG. 1 is a diagram illustrating a schematic configuration of an image forming system according to an embodiment of the present invention. The image forming system according to the embodiment includes the image forming apparatus F that forms an image on a sheet of paper, the creasing device A that creases the sheet, and a folding device B that folds the sheet at a predetermined position of the sheet.

The image forming apparatus F forms a visible image pertaining to image data fed from a scanner, a personal computer (PC), or the like on a sheet of paper. The image forming apparatus F uses a known print engine of electrophotography, droplet ejection printing, or the like.

The creasing device A includes a conveyance path 33, first to fifth pairs of conveying rollers 1 to 5 arranged from upstream to downstream of the conveyance path 33 in a sheet conveying direction, an entrance sensor SN1 provided upstream of the first pair of conveying rollers 1 and at a device entrance to detect a sheet, a creasing unit C provided between the third and fourth pairs of conveying rollers 3 and 4, and a skew correcting unit E in an immediate vicinity of the creasing unit C in the sheet conveying direction. The creasing unit C includes the creasing blade 6-1, the blade-side receiving member (creasing reinforce member) 6-2 that supports the creasing blade, the receiving block 7, a sheet retaining member 8, a spring 9 that presses the creasing blade 6-1, a spring fixing member 10, a spring 11 that presses the sheet retaining member 8, and a receiving unit 12 that receives a pressing force from the sheet retaining member 8. The skew correcting unit E includes a stopper plate 30, a stopper-plate driving cam 31, and a conveyance guide plate 32, and pinches a sheet between the creasing blade 6-1 and the receiving block 7 to form a crease that is concave toward the creasing blade 6-1.

The folding device B includes a discharge conveyance path 57, a processing conveyance path 58, sixth to ninth conveying rollers 51 to 54, and a folding unit D. The folding unit D includes a trailing-edge fence 60, folding rollers 55, a folding plate 61, and a first stacking tray T1 and a second stacking tray T2. A branching claw 50, which is used to select a path to which a sheet is conveyed, is provided at a branching portion into the discharge conveyance path 57 and the processing conveyance path 58. The seventh conveying rollers 52 serving as discharge rollers are provided most downstream of the discharge conveyance path 57.

Basic sheet conveyance operations performed in the image forming system illustrated in FIG. 1 after a sheet delivered from the image forming apparatus F is received and before the sheet is discharged to and stacked onto the stacking trays T1 and T2 are described below.

1) The sheet P delivered from the image forming apparatus F into the creasing device A passes by the entrance sensor SN1. Subsequently, the first to the fifth conveying rollers 1 to 5 start rotating based on detection information from the entrance sensor SN1, and the first and second conveying rollers 1 and 2 convey the sheet P to the skew correcting unit E.

The skew correcting unit E performs operations differently depending on whether skew correction is to be performed.

1-1) Situation where Skew Correction is to be Skipped

Figure 2:
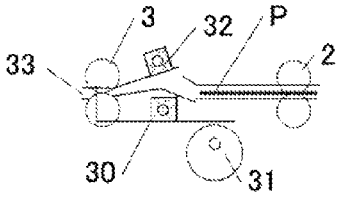
FIG. 2 is a schematic explanatory diagram of operations performed in a situation where skew correction by a skew correcting unit is skipped and illustrating a state where a leading edge of a sheet is located at a position immediately upstream of a stopper plate.
Figure 3:
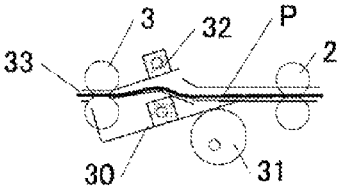
FIG. 3 is a schematic explanatory diagram of the operations performed in the situation where skew correction by the skew correcting unit is skipped and illustrating a state where the leading edge of the sheet has passed over the stopper plate.

FIG. 2 and FIG. 3 are schematic diagrams illustrating operations in a situation where skew correction is to be skipped. In the situation where skew correction is to be skipped, after the sheet P has been conveyed to the second conveying rollers 2 as illustrated in FIG. 2, the cam 31 rotates, causing the stopper plate 30 to retract from the conveyance path 33 as illustrated in FIG. 3. Thereafter, the sheet P is conveyed to the third conveying rollers 3 and then further conveyed toward the folding unit downstream. At that time, a conveyance speed of the second conveying rollers 2 and that of the third conveying rollers 3 are equal to each other.

1-2) Situation where Skew Correction is to be Performed

Figure 5:
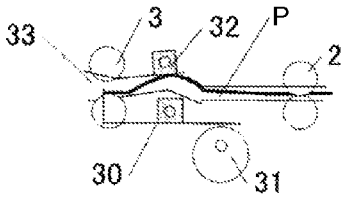
FIG. 5 is a schematic explanatory diagram of the operations performed in the situation where skew correction by the skew correcting unit is performed and illustrating a state where the leading edge of the sheet has abutted on the stopper plate.
Figure 4:
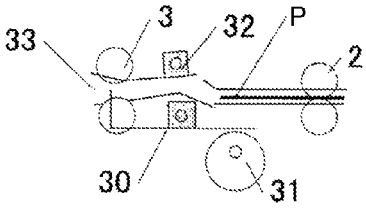
FIG. 4 is a schematic explanatory diagram of operations performed in a situation where skew correction by the skew correcting unit is performed and illustrating a state where a leading edge of a sheet is located at a position immediately upstream of the stopper plate and third conveying rollers are not pressed against each other and on standby.

FIGS. 4 to 9 are schematic diagrams illustrating operations to be performed in a situation where skew correction is to be performed. In the situation where skew correction is to be performed, when the sheet P has been conveyed to the second conveying rollers 2, the third conveying rollers 3 are at a standby state where pressure between the third conveying rollers 3 is released as illustrated in FIG. 4. When the sheet P is further conveyed and caused to abut on the stopper plate 30 by the second conveying rollers 2 as illustrated in FIG. 5, the sheet P is resiliently bent and hence subjected to skew correction.

Figure 8:
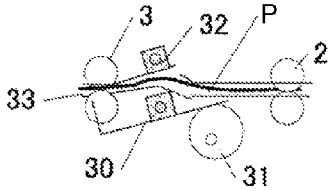
FIG. 8 is a schematic explanatory diagram of the operations performed in the situation where skew correction by the skew correcting unit is performed and illustrating a state where, subsequent to the state of FIG. 7, the sheet is being conveyed.
Figure 6:
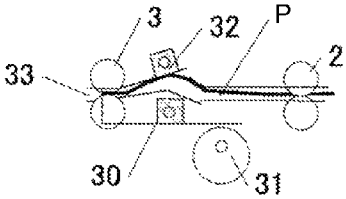
FIG. 6 is a schematic explanatory diagram of the operations performed in the situation where skew correction by the skew correcting unit is performed and illustrating a state where the leading edge of the sheet has abutted on the stopper plate and, after completion of skew correction, the third conveying rollers are pressed against each other.
Figure 9:
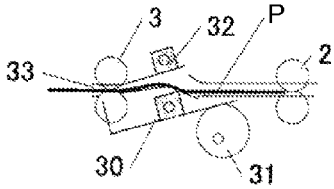
FIG. 9 is a schematic explanatory diagram of the operations performed in the situation where skew correction by the skew correcting unit is performed and illustrating a state where, subsequent to the state of FIG. 8, the sheet is conveyed only by the third conveying rollers so that a resiliently-bent part of the sheet is straightened.
Figure 7:
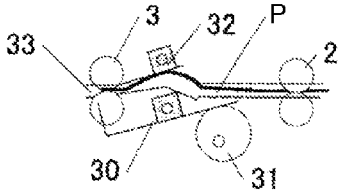
FIG. 7 is a schematic explanatory diagram of the operations performed in the situation where skew correction by the skew correcting unit is performed and illustrating a state where, subsequent to the state of FIG. 6, the stopper plate has retracted from a conveyance path.

After completion of the skew correction, the third conveying rollers 3 are brought into pressure contact with each other as illustrated in FIG. 6, and the stopper plate 30 is retracted from the conveyance path 33 as illustrated in FIG. 7. After the stopper plate 30 has been retracted, the sheet P is conveyed downstream by the second and third conveying rollers 2 and 3 as illustrated in FIG. 8. After the sheet P has passed through the second conveying rollers 2, the sheet P is conveyed only by the third conveying rollers 3 as illustrated in FIG. 9, which straightens a resiliently-bent part of the sheet P.

Meanwhile, the guide plate 32 is elevated and lowered in conjunction with ascending and descending motion of one conveying roller, which is depicted on an upper side in the drawing, of the third conveying rollers 3, thereby opening and closing the conveyance path 33.

2) Operations after Skew Correction

After passing through the skew correcting unit E, the sheet P reaches the creasing unit C. The creasing unit C operates differently depending on whether creasing is to be performed.

2-1) Situation where Creasing is to be Skipped

Figure 13:
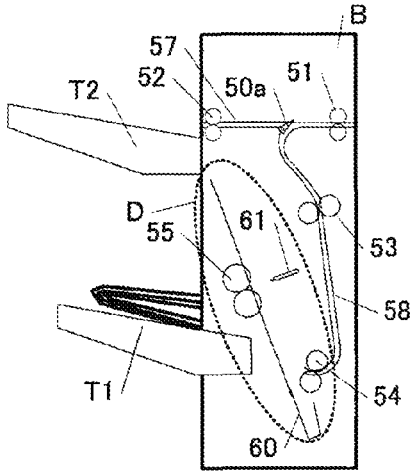
FIG. 13 is a schematic explanatory diagram of the operations performed in the situation where the folding device performs folding and illustrating a state where the center-folded sheet batch has been discharged onto a stacking tray.
Figure 14:
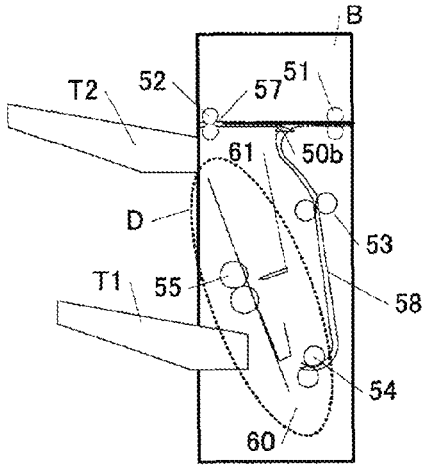
FIG. 14 is a schematic explanatory diagram of operations performed in a situation where the folding device skips folding and illustrating a state where a sheet is conveyed through a discharge conveyance path.
Figure 15:
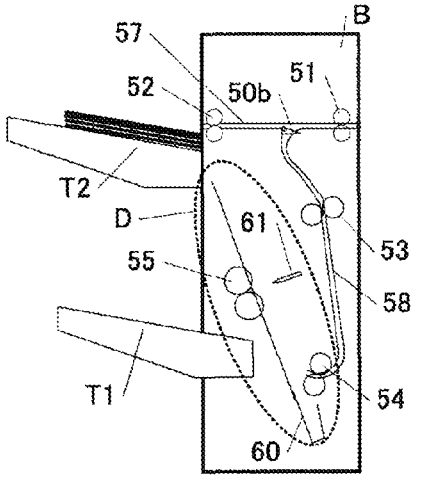
FIG. 15 is a schematic explanatory diagram of the operations performed in the situation where the folding device skips folding and illustrating a state where the sheet is discharged through the discharge conveyance path to a stacking tray and placed thereon.

FIGS. 10 to 13 are schematic explanatory diagrams of operations in a situation where the folding device B performs folding. FIGS. 14 and 15 are schematic diagrams illustrating operations in a situation where folding is to be skipped.

Figure 10:
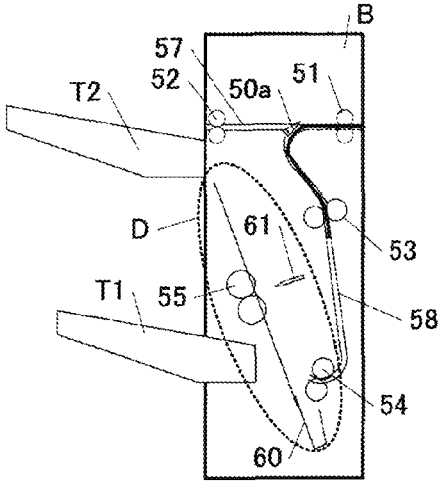
FIG. 10 is a schematic explanatory diagram of operations performed in a situation where a folding device performs folding and illustrating a state where a branching claw has been actuated to guide a sheet to a processing conveyance path.

After the sheet P passes through the skew correcting unit E, the sheet P is conveyed to the folding device B by the fourth and fifth conveying rollers 4 and 5. When the sheet P is to be conveyed to the folding device B and subjected to folding, the branching claw 50 is in a position, indicated by a symbol 50*a*, where the branching claw 50 closes the discharge conveyance path 57 but opens the processing conveyance path 58 as illustrated in FIG. 10. Hence, the sheet P is guided to the processing conveyance path 58 by the branching claw 50.

Figure 11:
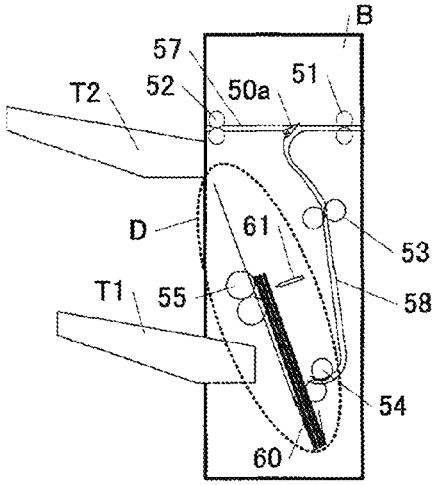
FIG. 11 is a schematic explanatory diagram of the operations performed in the situation where the folding device performs folding and illustrating a state where all sheets have been conveyed through the processing conveyance path and stacked on a processing tray.
Figure 12:
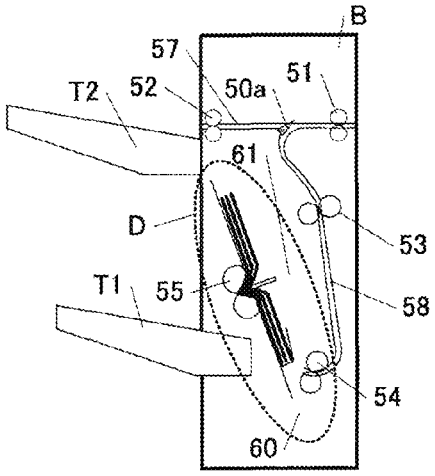
FIG. 12 is a schematic explanatory diagram of the operations performed in the situation where the folding device performs folding and illustrating a state where a sheet batch stacked on the processing tray is being center folded.

Thereafter, the sheet P is conveyed to the folding unit D by the eighth and ninth conveying rollers 53 and 54 and stacked on a processing tray as illustrated in FIG. 11. The stacked sheet P is conveyed (lifted up) by the trailing-edge fence 60 to a folding position. The sheet P is pushed to the folding rollers 55 by the folding plate 61 as illustrated in FIG. 12, to thus be folded by the folding rollers 55. Thereafter, the sheet P is discharged onto the stacking tray T1 as illustrated in FIG. 13.

In the situation where folding is to be skipped, the branching claw 50 is in a position, indicated by a symbol 50*b*, where the branching claw 50 opens the discharge conveyance path 57 but closes the processing conveyance path 58 as illustrated in FIG. 14. This causes the sheet P to be discharged through the discharge conveyance path 57 onto the stacking tray T2 by the seventh conveying rollers 52 as illustrated in FIG. 15.

2-2) Situation where Creasing is to be Performed

To ensure creasing quality, skew correction is always performed when creasing is to be performed. A user can configure settings so as to skip skew correction.

Figure 16:
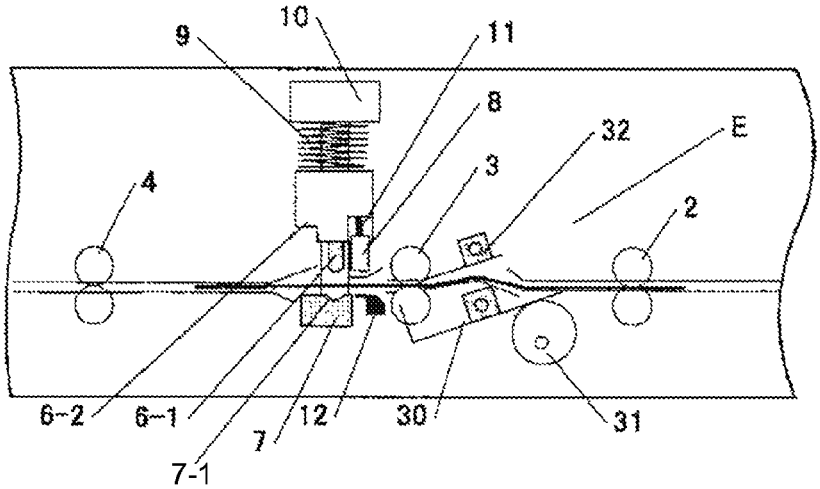
FIG. 16 is a schematic explanatory diagram of creasing operations and illustrating a state where a sheet having been subjected to skew correction is conveyed by a specified distance to a creasing unit.
Figure 17:
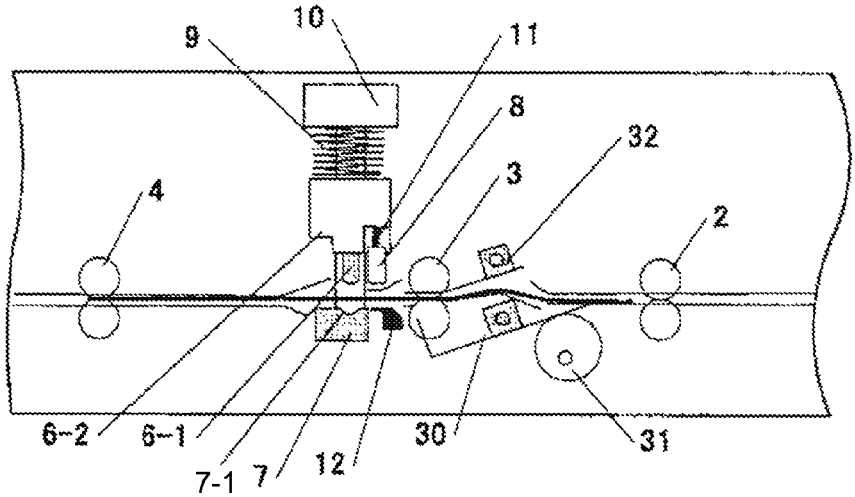
FIG. 17 is a schematic explanatory diagram of the creasing operations and illustrating a state where the sheet having been subjected to skew correction is conveyed to a creasing position and stopped.
Figure 18:
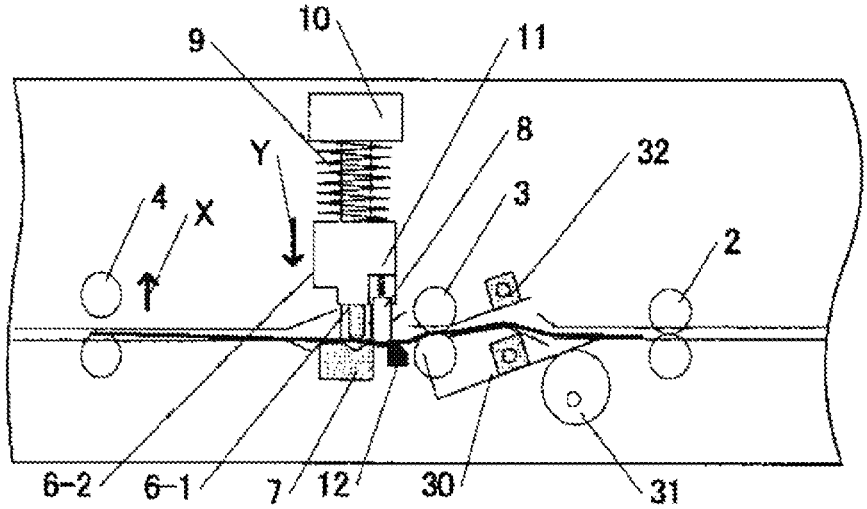
FIG. 18 is a schematic explanatory diagram of the creasing operations and illustrating a state where, after a sheet retainer has made a contact with the sheet stopped at the creasing position, pressure between fourth conveying rollers is released.

FIGS. 16 to 21 are schematic diagrams illustrating creasing operations. As illustrated in FIG. 16, after the skew correction, the third conveying rollers 3 convey the sheet P by a specified distance from the stopper plate 30 to the creasing unit C. When the sheet P is thus conveyed at a creasing position as illustrated in FIG. 17, the sheet P is stopped. When the sheet P is stopped, the creasing blade 6-1 is moved down in a direction indicated by arrow Y as illustrated in FIG. 18. The sheet retaining member 8 makes pressure contact with the receiving unit 12 with the sheet P therebetween, and thereafter an upper roller of the fourth conveying rollers 4 is moved up as indicated by arrow X, releasing pressure between the fourth conveying rollers 4.

Figure 19:
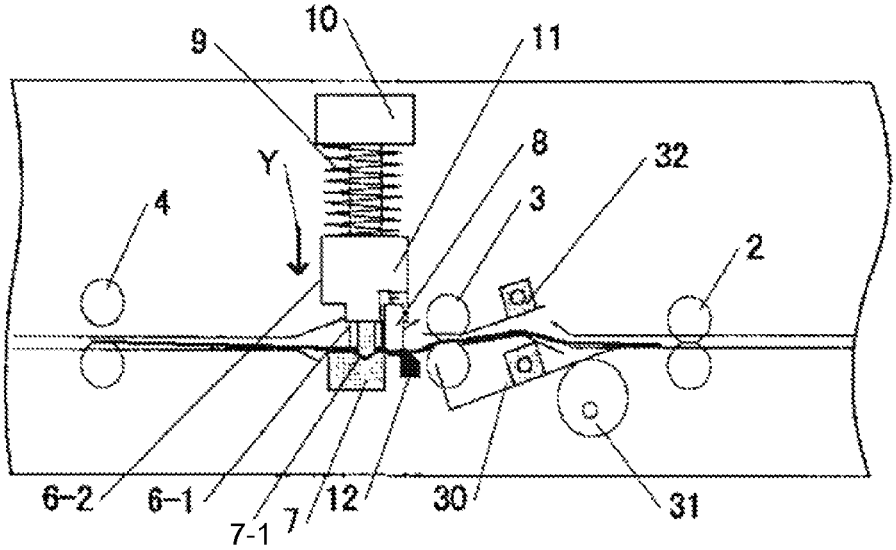
FIG. 19 is a schematic explanatory diagram of the creasing operations and illustrating a state where the sheet stopped at the creasing position is being creased.
Figure 20:
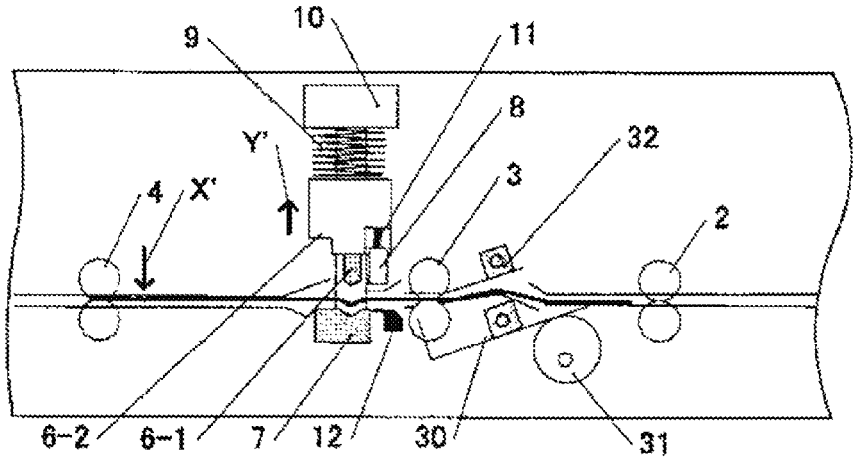
FIG. 20 is a schematic explanatory diagram of the creasing operations and illustrating a state where, after the sheet has stopped at the creasing position, a creasing member is moved to be separated from the sheet.
Figure 21:
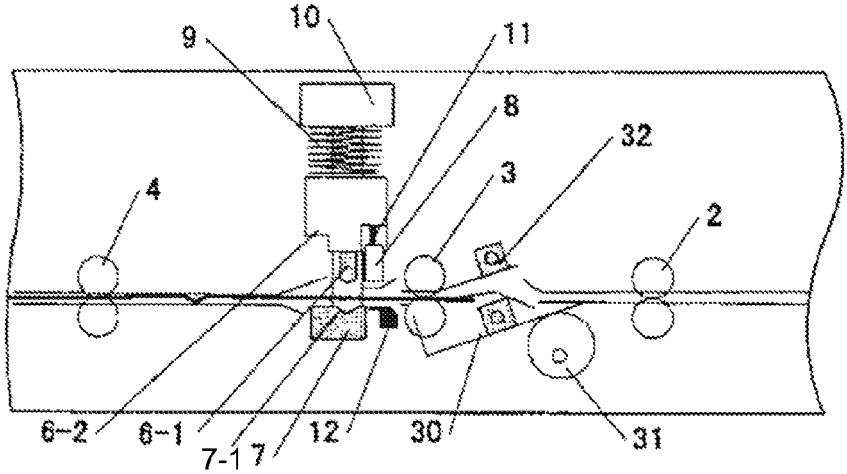
FIG. 21 is a schematic explanatory diagram of the creasing operations and illustrating a state where the creasing member has been separated from the sheet and the sheet is started to be conveyed.

As illustrated in FIG. 19, after the pressure between the fourth conveying rollers 4 is released, the creasing blade 6-1 is further moved down in the Y direction to pinch the sheet P between the creasing blade 6-1 and the receiving block 7 with a predetermined pressure. During this process, a crease is formed in the sheet P. After completion of the creasing, as illustrated in FIG. 20, the creasing blade 6-1 is moved up in a direction indicated by arrow Y'. At a timing when the creasing blade 6-1 is separated from the sheet P, the fourth conveying rollers 4 are moved down in a direction indicated by arrow X' to press the sheet P again, thereby becoming ready for conveying the sheet P. Thereafter, as illustrated in FIG. 21, the sheet P is conveyed downstream by the fourth conveying rollers 4.

When the sheet P has been conveyed to the folding device B, the operations described with reference to FIGS. 10 to 13 or FIGS. 14 and 15 are performed as in the situation described above in 2-1) where creasing is to be skipped.

Figure 22:
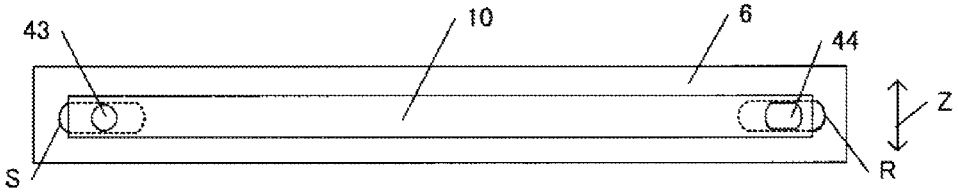
FIG. 22 is a plan view of a relevant portion of the creasing unit for illustration of its configuration.
Figure 23:
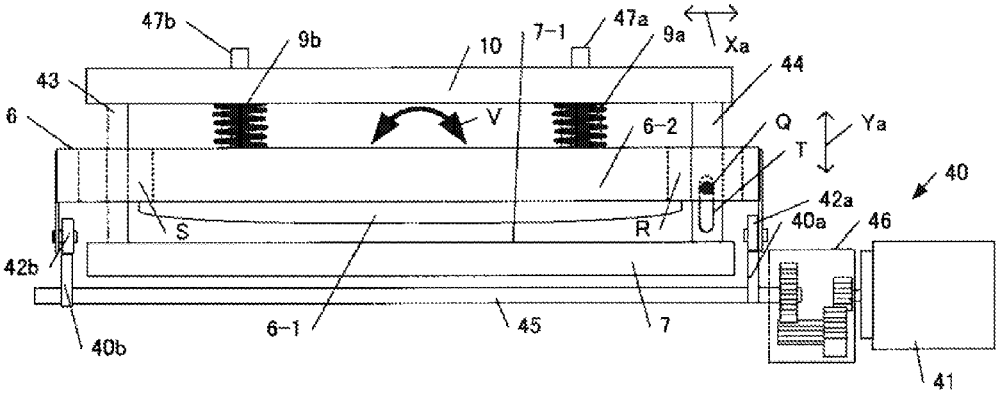
FIG. 23 is an elevation view of a relevant portion of the creasing unit for illustration of its configuration.

The configuration of the creasing unit C that performs the creasing operations described above is illustrated in detail in FIG. 22, which is a plan view of a relevant portion of the creasing unit C, and in FIG. 23, which is an elevation view (elevation view related with the plan view of FIG. 22). In FIG. 22 and FIG. 23, that the creasing unit C includes the creasing member 6 (the creasing blade 6-1 and the blade-side receiving member 6-2), the receiving block 7, and the drive mechanism 40.

The creasing member 6 has, in addition to the creasing blade 6-1 provided at a lower end of the creasing member 6, a first elongated hole R and a second elongated hole S, into which a first support shaft 44 and a second support shaft 43, which will be described later, are to be loosely fit, respectively, and includes a first positioning member 42*a* and a second positioning member 42*b* provided at a rear end portion and a front end portion, respectively. The first and second elongated holes R and S are elongated in a direction perpendicular to the sheet conveying direction and configured to allow the creasing member 6 to pivot relative to the first and second support shafts 44 and 43 in a plane that lies perpendicularly to the sheet conveying direction but not to allow the creasing member 6 to move in the sheet conveying direction. The first and second positioning members 42*a* and 42*b* are suspended substantially vertically downward from a rear end and a front end of the blade-side receiving member 6-2. The first and second positioning members 42*a* and 42*b* serve as disciform cam followers that are rotatably supported at their centers and brought into contact with a first cam 40*a* and a second cam 40*b* to roll on the first cam 40*a* and the second cam 40*b*. Meanwhile, the front side of the device corresponds to the left-hand side in FIGS. 22 and 23.

The receiving block 7 is coupled via the first and second support shafts 44 and 43 to the spring fixing member 10 located above the creasing member 6 and moved in one piece with the spring fixing member 10. At two end portions of the creasing member 6 in a longitudinal direction thereof, the spring fixing member 10 are provided with a first shaft member 47*a* closer to a rear and a second shaft member 47*b* closer to a front. A first elastic member 9*a* closer to the rear and a second elastic member 9*b* closer to the front are mounted on an outer periphery of the first shaft member 47*a* and an outer periphery of the second shaft member 47*b*, respectively, and constantly resiliently urge the spring fixing member 10 and accordingly the receiving block 7 upward. The first support shaft 44 has a cross-sectional profile having a shape like a rectangle with short sides thereof formed in a semicircular shape, and is loosely fit in the first elongated hole R. A third elongated hole T elongated in a vertical direction is defined in the first support shaft 44 at a portion lower than a middle of the first support shaft 44. A rotating shaft Q is vertically inserted into the third elongated hole T from a side-surface side of the creasing member 6 (in a direction perpendicular to the plane of FIG. 23). The diameter of the rotating shaft Q is set to a dimension, relative to the width of the third elongated hole T, that allows the rotating shaft Q to move in Ya directions in FIG. 23 but prevents the same from moving in Xa directions. This allows the first support shaft 44 to rotate about the rotating shaft Q and move in the longitudinal direction of the third elongated hole T. These configurations described above allow pivoting motion as indicated by arrow V in FIG. 23.

The drive mechanism 40 is a mechanism that rotates the cams 40*a* and 40*b*, which are in contact with the positioning members 42*a* and 42*b*, to press the creasing member 6 against the receiving block 7 and move the creasing member 6 away from the receiving block 7. The drive mechanism 40 includes a camshaft 45, which coaxially connects the first cam 40*a* closer to the rear of the device and the second cam 40*b* closer to the front of the device, a drive gear train 46, through which the camshaft 45 is driven at an end portion (in the present embodiment, a rear end portion) of the camshaft 45, and a drive motor 41 that drives the drive gear train 46. The first cam 40*a* and the second cam 40*b* are located to face and come into contact with the first positioning member 42*a* and the second positioning member 42*b*, respectively. The cams 40*a* and 40*b* move the creasing member 6 toward and away from the receiving block 7 based on distances from a center of the camshaft 45 to rotational centers of the positioning members 42*a* and 42*b* measured along straight lines extending from the center of the camshaft 45 to the rotation centers of the positioning members 42*a* and 42*b*. At this time, a range where the creasing member 6 moves is confined by the first and second support shafts 44 and 43 and the first and second elongated channels R and S. The creasing member 6 reciprocates under this confined state. A configuration that brings, based on shapes of the first and second cams 40*a* and 40*b*, the creasing blade 6-1 of the creasing member 6 into contact with the receiving block 7 in an orientation inclined relative to the receiving block 7 rather than parallel with the receiving block 7 so that the creasing blade 6-1 oriented obliquely relative to a plane of the sheet starts to produce a crease in the sheet is employed. A face of a blade edge of the creasing blade 6-1 is arcuate as illustrated in FIG. 23.

FIGS. 24 to 29 are schematic illustrations of operations performed to crease a sheet by using the creasing member 6. Creasing operations start when the drive motor 41 starts to rotate in response to an instruction fed from control circuit not shown.

Figure 24:
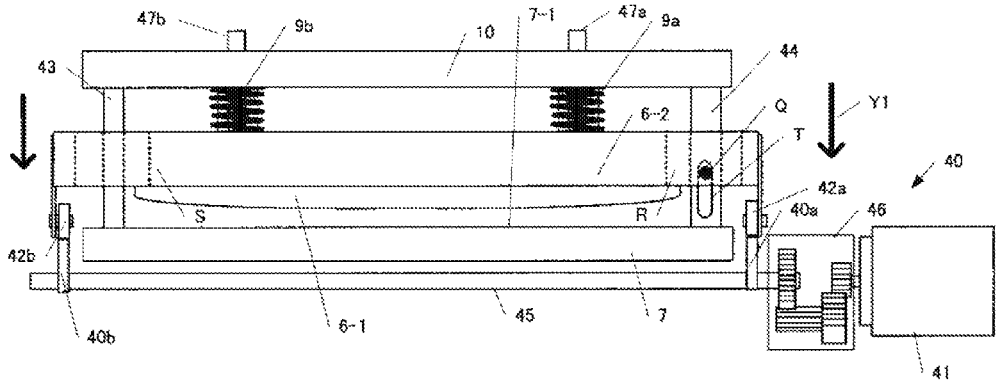
FIG. 24 is a schematic explanatory diagram of operations performed to crease a sheet by using the creasing member and illustrating an initial position where the creasing member is positioned uppermost.

More specifically, when the drive motor 41 starts to rotate from the state illustrated in FIG. 24 (where a sheet has been conveyed to and stopped at the creasing position), which corresponds to an initial position, the camshaft 45 is rotated via the drive gear train 46, which in turn rotates the first and second cams 40*a* and 40*b*. As the first and second cams 40*a* and 40*b* rotate, the first and second positioning members 42*a* and 42*b*, which are the cam followers that abut and roll on the first and second cams 40*a* and 40*b*, are rotated, causing center distances from the first and second positioning members 42*a* and 42*b* to the first and second cams 40*a* and 40*b*, respectively, to change, causing movement in a direction indicated by Y1.

Figure 25:
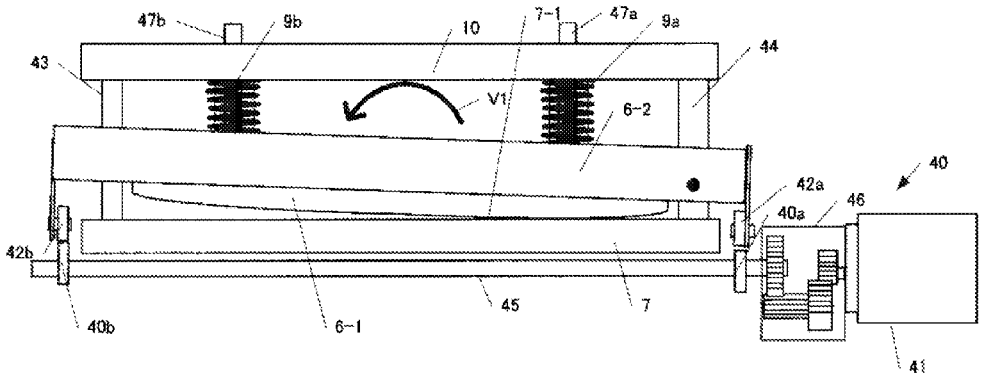
FIG. 25 is a schematic explanatory diagram of the operations performed to crease the sheet by using the creasing member and illustrating a state where a creasing blade has abutted on a creasing channel.

When the creasing blade 6-1 abuts on the creasing channel 7-1 of the receiving block 7 as illustrated in FIG. 25, the receiving block 7 regulates movement of the creasing member 6. When the drive motor 41 further rotates from this state, the first positioning member 42*a* and the first cam 40*a* are separated from each other. At this time, the second positioning member 42*b* is in contact with the second cam 40*b* because a portion, closer to the front of the device, of the creasing blade 6-1 of the creasing member 6 is not abutting on the receiving block 7. An abutting position where the creasing blade 6-1 abuts on the creasing channel 7-1 of the receiving block 7 is out of a range where sheets are conveyed; accordingly, as the abutting position changes after the creasing blade 6-1 has abutted on the creasing channel 7-1, a sheet comes to be interposed between the creasing blade 6-1 and the creasing channel 7-1.

Figure 26:
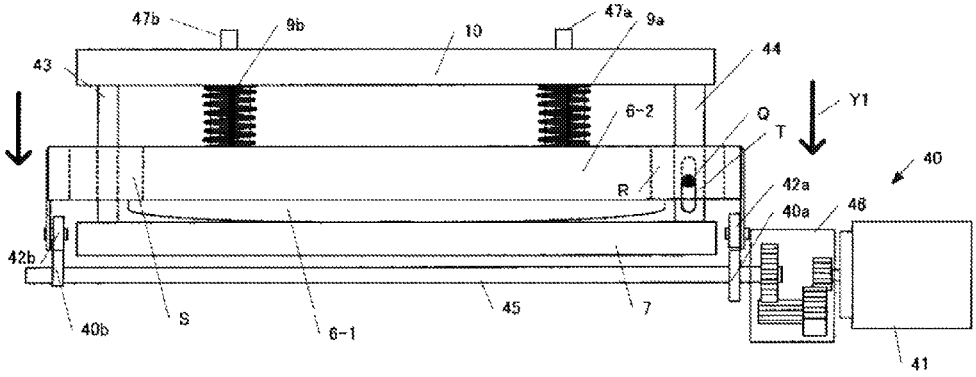
FIG. 26 is a schematic explanatory diagram of the operations performed to crease the sheet by using the creasing member and illustrating a state where the creasing blade has abutted on the creasing channel to perform creasing.

When the drive motor 41 further rotates from the state illustrated in FIG. 25, the portion, closer to the front of the device, of the creasing blade 6-1 is also brought into contact with the creasing channel 7-1 of the receiving block 7 as illustrated in FIG. 26. Accordingly, the sheet P is applied with pressure by elastic force of the first and second elastic members 9*a* and 9*b*, forming a crease in the sheet P.

Figure 27:
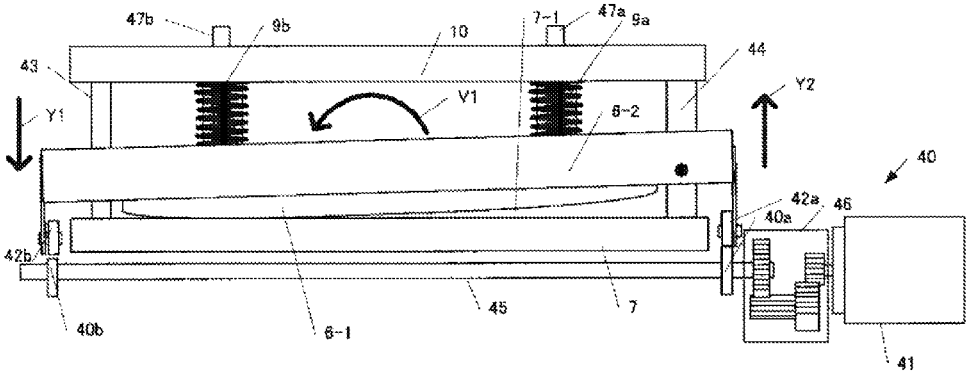
FIG. 27 is a schematic illustration of the operations performed to crease the sheet by using the creasing member, illustrating a state where an abutting position where the creasing blade has abutted on the creasing channel has moved toward a front side of the device, causing a contact position to be separated from the sheet.
Figure 28:
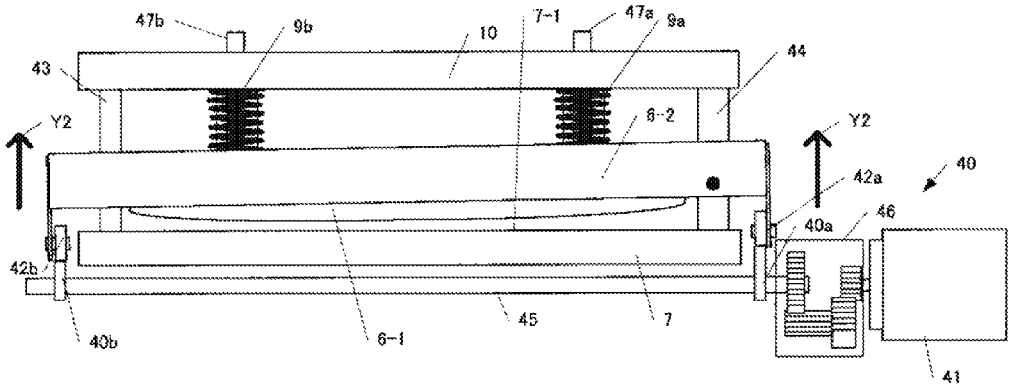
FIG. 28 is a schematic explanatory diagram of the operations performed to crease the sheet by using the creasing member, and illustrating a state where the creasing blade has separated from a receiving block.

After the crease has been formed, the drive motor 41 further rotates, causing the camshaft 45 and the first and second cams 40*a* and 40*b* to rotate. As illustrated in FIG. 27, the first positioning member 42*a* and the first cam 40*a* are brought into contact with each other earlier than the second positioning member 42*b* and the second cam 40*b*, and the first cam 40*a* pushes up the first positioning member 42*a* closer to the rear, moving up a portion, closer to the rear, of the creasing member 6 in a direction indicated by arrow Y2 earlier than a portion, closer to the front, of the creasing member 6. As illustrated in FIG. 28, when a lower end of a part, closer to the front, i.e., closer to the first positioning member 42*a*, of the creasing blade 6-1 is separated from the receiving block 7, the second positioning member 42*b* and the second cam 40*b* closer to the front of the device come into contact with each other, and a face of a part, closer to the second positioning member 42*b*, of the creasing member 6 also ascends in the Y2 direction.

Figure 29:
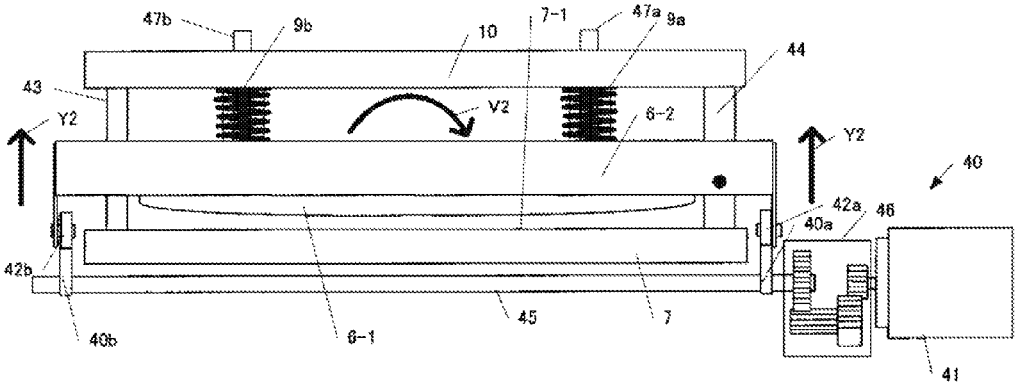
FIG. 29 is a schematic explanatory diagram of the operations performed to crease the sheet by using the creasing member and illustrating a state where the creasing member, after separation from the receiving block, pivots in an opposite direction to return to an initial state.

The lower end of the part, closer to the first positioning member 42*a*, of the creasing blade 6-1 is stopped for a while at the position separated from the receiving block 7. When an upper surface of the creasing member 6 is oriented horizontally as illustrated in FIG. 29, the creasing member 6 ascends while maintaining the horizontal orientation to return to a standby position, or, put another way, the initial position illustrated in FIG. 25. At the initial position, the creasing blade 6-1 is inclined such that the portion, closet to the rear, of the creasing blade 6-1 is closer to the receiving block 7 than the portion closet to the front.

In this process, as illustrated in FIG. 25, after the portion, closer to the rear of the device, of the creasing blade 6-1 has abutted on the receiving block 7, the creasing blade 6-1 rotates counterclockwise (indicated by arrow V1) in FIG. 25. After both ends of the creasing member 6 have ascended in the Y2 direction in FIG. 28, the creasing member 6 pivots clockwise (in a direction indicated by arrow V2) in FIG. 29. The creasing member 6 is thus constructed to produce a crease with an arcuate blade (the creasing blade 6-1) through motion thereof, about a pivot center provide at a part colder to the rear of the device, similar to that of a cutter that is provide with a pivot center at an end thereof and performs cutting with a pressure. This motion is produced by the shapes of the first and second cams 40*a* and 40*b*.

FIGS. 30A to 30E are schematic diagrams of operations illustrating how positional relationship between the receiving block 7 and the creasing member 6 changes as positional relationship between the cams 40*a* and 40*b* and the positioning members 42*a* and 42*b* changes. In FIGS. 30A to 30E, relationships of rotational positions of the first cam 40*a* with those of the first positioning member 42*a* closer to the rear of the device are depicted on the right-hand side; relationships of rotational positions of the second cam 40*b* with those of the second positioning member 42*b* closet to the front of the device are depicted on the left-hand side. Positional relationship between the creasing channel 7-1 of the receiving block 7 and the creasing blade 6-1 of the creasing member 6 that depends on rotations of the first and second cams 40*a* and 40*b* are depicted at a portion between the right-hand side and the left-hand side.

Figures 30A, 30B, 30C, 30D, 30E:
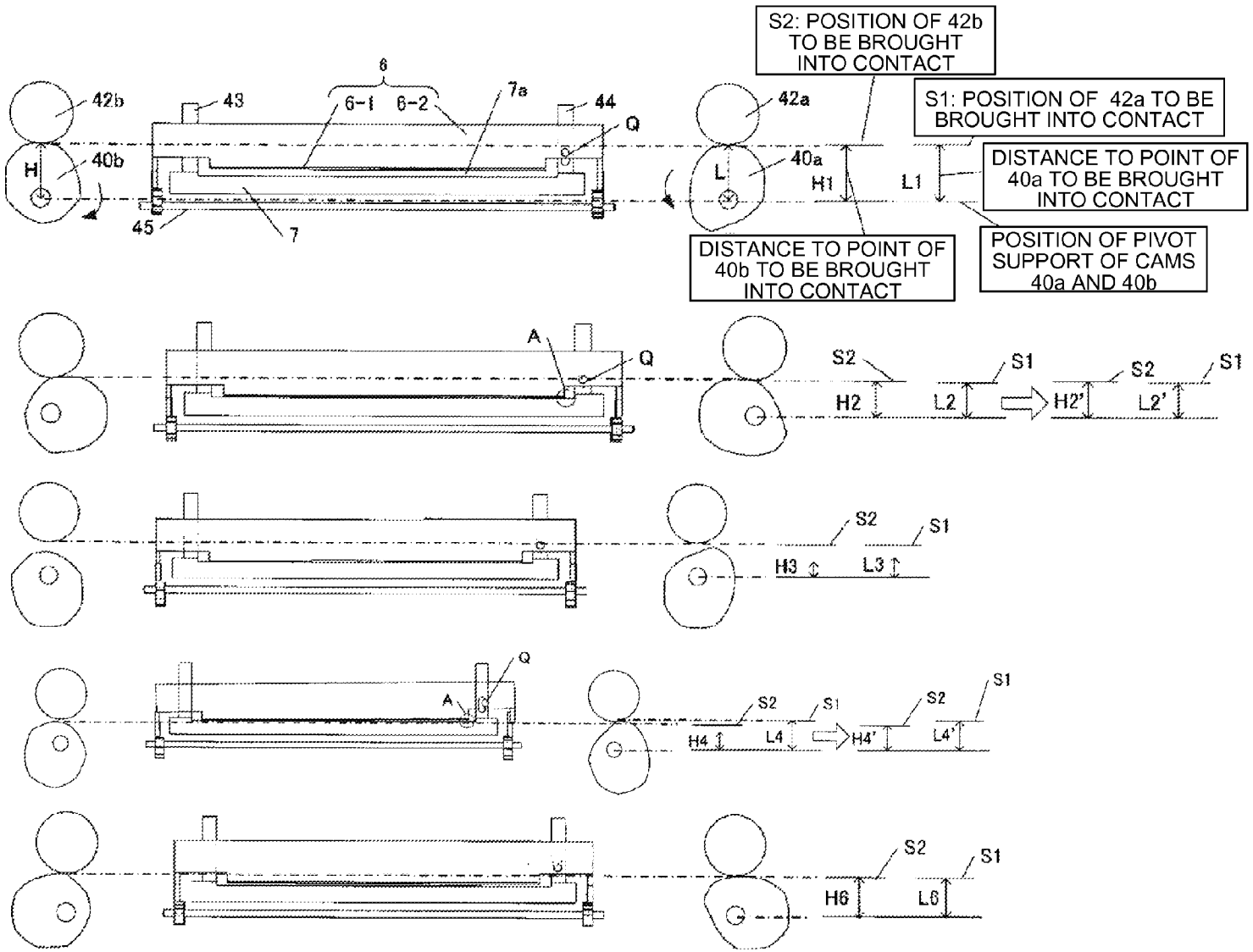
FIG. 30A to 30E are schematic explanatory diagrams of operations and illustrating how positional relationship between the receiving block and the creasing member changes as positional relationship between cams and positioning members changes.

FIG. 30A illustrates a position of the creasing blade 6-1 relative to the receiving block 7 in a period where a sheet has been conveyed into the creasing device A, conveyed to a folding position, and stopped at the folding position. This position is the initial position. In FIGS. 30A to 30E, L denotes a distance measured along a straight line passing through the center of the camshaft 45 of the first cam 40*a* and a center of a rotating axis of the first positioning member 42*a*, from the center of the camshaft 45 of the first cam 40*a* to an outer periphery of the first cam 40*a* to be brought into contact with the positioning member 42*a*. H denotes a distance measured along a straight line passing through the center of the camshaft 45 of the second cam 40*b* and a center of a rotating axis of the second positioning member 42*b*, from the center of the camshaft 45 of the second cam 40*b* to an outer periphery of the second cam 40*b* to be brought into contact with the second positioning member.

When, in FIG. 30A, a distance from the center of the rotating axis of the first cam 40*a* to an outer periphery of the first positioning member 42*a* to be brought into contact is denoted by S1 and a distance from the center of the rotating axis of the second cam 40*b* to an outer periphery of the second positioning member 42*b* to be brought into contact is denoted by S2, relationships among the distance S1, the distance L1, the distance S2, and the distance H1 can be expressed by the following equations.

$$S1=L1$$

$$S2=H1$$

$$H1=L1$$

In this state, the creasing blade 6-1 and the creasing channel 7-1 are in a positional relationship illustrated in FIG. 24, where a clearance between the creasing blade 6-1 and the creasing channel 7-1 at a part closer to the rear and a part closer to the front are equal to each other. Meanwhile, H is a distance to a point of the second cam 40*b* to be brought into contact with the corresponding cam follower; L is a distance to a point of the first cam 40*a* to be brought into contact with the corresponding cam follower.

FIG. 30B illustrates relevant elements in a state where a portion A, closest to the rear, of the creasing blade 6-1 has come into contact with the receiving block 7. A position of the portion A is set to be located outside of a position at which an edge of a sheet of a maximum size to be creased in the present embodiment passes. A portion, closer to the front, of the creasing blade 6-1 descends as the creasing blade 6-1 pivots about the portion A that is at outer position (rear portion). A relationship between a distance H2 and a distance L2 in a period from a start of the operation until the portion A of the creasing blade 6-1 comes into contact with the receiving block 7 can be expressed by the following equation.

$$H2=L2$$

Accordingly, a portion, closer to the front, and a portion, closer to the rear, of the creasing blade 6-1 move (descend) by the same distance concurrently. FIG. 25 illustrates this positional relationship.

In a state where the first and second cams 40*a* and 40*b* are further rotated after the portion A has come into contact with the receiving block 7, as illustrated in FIG. 30B, relationship between the distance S1 and a distance L2', and that between the distance S2 and a distance H2' can be expressed by the following expressions.

$$S1>L2'$$

$$S2=H2'$$

In this process, the creasing member 6 rotates about the rotating shaft Q.

FIG. 30C illustrates a position at a time when the creasing member 6 has pivoted about the rotating shaft Q and the blade face of the creasing blade 6-1 comes into contact with the creasing channel 7-1 of the receiving block 7. As can be seen from FIG. 30C, relationship between the distance S1 and a distance L3, and relationship between the distance S2 and a distance H3 at a time of this contact can be expressed by the following expressions.

$$S1>L3$$

$$S2>H3$$

The distances L3 and H3 are smaller at both sides. Hence, the elastic members 9*a* and 9*b* press the creasing member 6, causing the creasing blade 6-1 to be fitted into the creasing channel 7-1 of the receiving block 7 with a sheet therebetween, thereby producing a crease in the sheet. FIG. 26 illustrates this positional relationship.

FIG. 30D illustrates a position at a time when the portion A of the creasing blade 6-1 separates from the receiving block 7. Relationship between the distance S1 and a distance L4, and relationship between the distance S2 and a distance H4 at the time of this separation can be expressed by the following expressions.

$$S1=L4$$

$$S2>H4$$

Thereafter, the positional relationships shift to positional relationships that can be expressed by the following equations.

$$S1=L4'$$

$$S2=H4'$$

FIG. 27 illustrates this positional relationship.

Meanwhile, the distance S1 at the rear is kept constant until the distance S2 at the front reaches the distance S1 at the rear side. As illustrated in FIG. 30E, after a relationship expressed by S1=S2 has been established, the creasing blade 6-1 returns to the standby position illustrated in FIG. 30A.

The shapes of the cams 40*a* and 40*b* are configured such that a speed increases after the creasing blade 6-1 starts to move away in FIG. 30D. In FIGS. 30A to 30E, the creasing blade 6-1 is depicted as having a linear shape; however, this is because FIGS. 30A to 30E are scaled down by a large scale factor for convenience of drawing, making it difficult to distinguish intersecting lines near the blade edge of the creasing blade 6-1. As illustrated in FIGS. 23 to 29, the creasing blade 6-1 actually has an arcuate shape convex downward. Furthermore, the creasing blade 6-1 is preferably configured to come into contact with the creasing channel 7-1 at a low speed at an instant when a contact therebetween is made, and after the contact, be moved at a high speed. This drive control can be implemented by using the shapes of the cams or by performing motor control.

By performing the operations described above, sheets P are, on a sheet-by-sheet basis, creased and then conveyed into the folding device B.

Figure 31A:
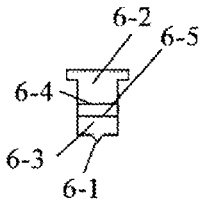
FIGS. 31A and 31B are diagrams illustrating the configuration of the creasing member according to the present embodiment.
Figure 31B:
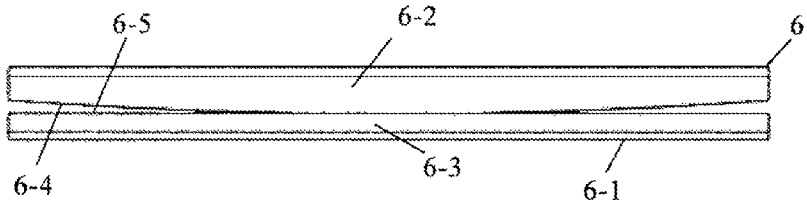
Figure 32A:
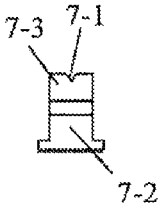
FIGS. 32A and 32B are diagrams illustrating the configuration of the receiving block according to the present embodiment.
Figure 32B:
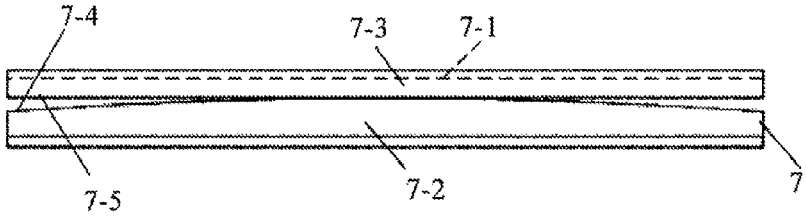
Figure 33A:
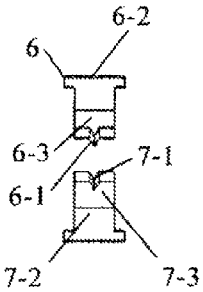
FIGS. 33A and 33B are diagrams illustrating the creasing member and the receiving block formed with members illustrated in FIGS. 31A to 32B.
Figure 33B:
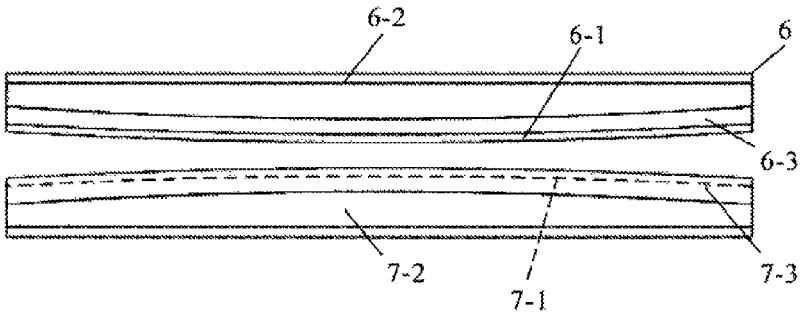

FIGS. 31A and 31B are diagrams illustrating the configuration of the creasing member 6 according to the present embodiment. FIGS. 32A and 32B are diagrams illustrating structure of the receiving block 7. FIGS. 33A and 33B are diagrams illustrating the creasing member 6 and the receiving block 7 formed with members illustrated in FIGS. 31A to 32B. Each of FIGS. 31A, 32A, and 33A is a left side view while each of FIGS. 31B, 32B, and 33B is a front view as viewed from the sheet conveying direction.

In FIGS. 31A and 31B, the creasing member 6 includes the blade member 6-3, on which the creasing blade 6-1 is formed, and the blade-side receiving member 6-2 that supports the blade member 6-3 at a back surface of the blade member 6-3. The blade member 6-3 has a column-like shape with a substantially rectangular cross section. The blade member 6-3 includes, on its lower surface of FIGS. 31A and 31B, the creasing blade 6-1 that linearly extends along a longitudinal direction of the blade member 6-3. The blade-side receiving member 6-2 also has a column-like shape with substantially rectangular cross section and of approximately same length as the blade member 6-3. In FIGS. 31A and 31B, the blade-side receiving member 6-2 has the lower surface 6-4 formed in an arcuate (convex) curved surface. An upper surface 6-5, which is flat in an initial state, of the blade member 6-3 is attached to the lower surface 6-4.

Similarly, the receiving block 7 includes the channel member 7-3, in which the creasing channel 7-1 is defined, and the channel-side receiving member 7-2 that supports the channel member 7-3 at a back surface of the channel member 7-3. The channel member 7-3 is columnar has a column-like shape with a substantially rectangular cross section. The channel member 7-3 includes the creasing channel 7-1 that is notched in the upper surface, in FIGS. 32A and 32B, of the channel member 7-3. The creasing channel 7-1 linearly extends along a longitudinal direction of the channel member 7-3. The channel-side receiving member 7-2 also has a column-like shape with a substantially rectangular cross section and of approximately same length as the channel member 7-3. In FIGS. 32A and 32B, the channel-side receiving member 7-2 has the upper surface 7-4 formed in an arcuate (convex) curved surface. A lower surface 7-5, which is flat in an initial state, of the channel member 7-3 is attached to the upper surface 7-4.

The blade-side receiving members 6-2 and the channel-side receiving member 7-2 of the creasing member 6 and the receiving block 7 are identical in shape but differ from each other only in orientation such that one faces downward while the other faces upward in FIGS. 31A to 33B. Meanwhile, the blade member 6-3 and the channel member 7-3 differ from each other only in the creasing blade 6-1 and the creasing channel 7-1, i.e., only in that the creasing blade 6-1 is linearly formed on the lower surface of the blade member 6-3 while the creasing channel 7-1 is linearly defined in the upper surface of the channel member 7-3 but a portion for the creasing blade 6-1 of the blade member 6-3 and a portion for the creasing channel 7-1 of the channel member 7-3 are identical in shape.

The creasing member 6 and the receiving block 7 are configured in this manner. As illustrated in FIGS. 33A and 33B, in the creasing member 6, the upper surface 6-5 of the blade member 6-3 is attached to the lower surface 6-4 of the blade-side receiving member 6-2, while, in the receiving block 7, the lower surface 7-5 of the channel member 7-3 is attached to the upper surface 7-4 of the channel-side receiving member 7-2. Accordingly, the blade member 6-3 is fixed in a state where the blade member 6-3 is deformed along the curvature of the lower surface 6-4 of the blade-side receiving member 6-2, while the channel member 7-3 is fixed in a state where the channel member 7-3 is deformed along the curvature of the upper surface 7-4 of the channel-side receiving member 7-2. Therefore, it is possible to cause each of the creasing blade 6-1 and the creasing channel 7-1 to function as the creasing member 6 that is arcuate with a positive curvature and the receiving block 7 that is arcuate with a positive curvature, respectively, by arranging the creasing blade 6-1 and the creasing channel 7-1 to face each other.

This configuration eliminates the need of manufacturing the blade-side receiving members 6-2 and the channel-side receiving member 7-2 differently because the blade-side receiving members 6-2 and the channel-side receiving member 7-2 are identical in shape. Furthermore, each of the blade member 6-3 and the channel member 7-3 can be formed into a linear shape. Accordingly, working of the blade member 6-3 and the channel member 7-3 can be simplified and therefore manufacturing cost can be reduced.

Figure 34A:
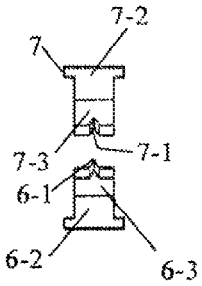
FIGS. 34A and 34B are diagrams illustrating a state where arrangement of the creasing blade and the creasing is vertically reversed from that illustrated in FIGS. 33A and 33B.
Figure 34B:
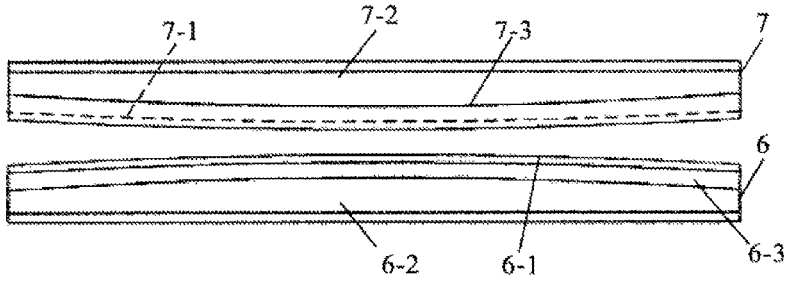

Furthermore, it is also easy to change an arrangement illustrated in FIGS. 33A and 33B where the creasing blade 6-1 is arranged above to an arrangement illustrated in FIGS. 34A and 34B where the creasing blade 6-1 is arranged below because the blade-side receiving members 6-2 and the channel-side receiving member 7-2 are identical in shape. This is because the creasing unit C can adapt to this arrangement change without changing structure thereof because the blade-side receiving members 6-2 and the channel-side receiving member 7-2 are identical in shape. This facilitates selecting or changing a face of a sheet toward which a crease is to be formed. FIGS. 34A and 34B are diagrams illustrating a state where arrangement of the creasing blade 6-1 and the creasing channel 7-1 is vertically reversed from that illustrated in FIGS. 33A and 33B.

This configuration makes it possible to manufacture, with regard to the creasing channel 7-1, a plurality of channel members 7-3 that differ from one another in shape, depth, or the like and perform creasing with any one of the channel members 7-3 attached to the channel-side receiving member 7-2. This change of the channel member 7-3 can be performed depending on, for instance, a sheet thickness, a sheet type (special paper, e.g., coated paper), and a portion (e.g., front cover) in a booklet and makes it possible to adapt to a variety of creasing (variety in requirement to size or depth of a crease to be formed) easily.

Figure 35A:
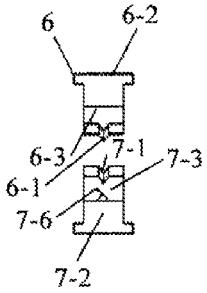
FIGS. 35A and 35B are diagrams illustrating an example where another creasing channel is defined in the channel member on a lower surface in FIGS. 33A and 33B.
Figure 35B:
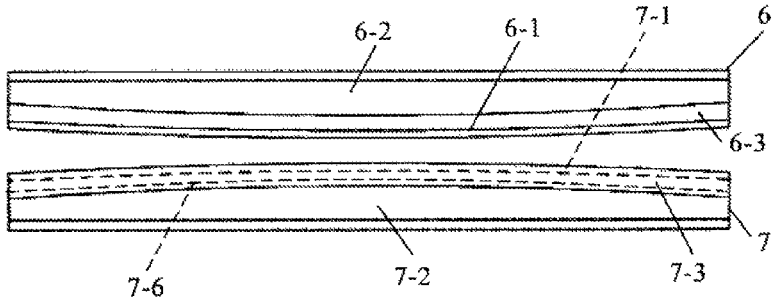

FIGS. 35A and 35B are diagrams illustrating an example where another channel 7-6 that differs in depth from the creasing channel 7-1 defined on the upper surface of the channel member 7-3 in FIGS. 33A and 33B is additionally defined on the lower surface. Providing a channel in the channel member 7-3 does not affect attachment of the channel member 7-3 to the channel-side receiving member 7-2 because no projection is provided on an attachment surface where the channel member 7-3 is to be attached to the channel-side receiving member 7-2. Accordingly, in the present example, each of the creasing channels 7-1 and 7-6 that differ in depth is defined on one of the two surfaces of the channel member 7-3 so that the channel member 7-3 can be attached to the channel-side receiving member 7-2 with the channel member 7-3 turned upside down according to a requirement to creasing.

The blade member 6-3 and the channel member 7-3 are preferably mechanically attached to the blade-side receiving members 6-2 and the channel-side receiving member 7-2, respectively, with, for instance, screws, at a plurality of positions. The blade member 6-3 and the channel member 7-3 are preferably detachably fixed to the blade-side receiving members 6-2 and the channel-side receiving member 7-2, respectively. The first and second blade-side receiving members 6-2 and the channel-side receiving member 7-2 are configured to be identical in an attachment position, while the blade member 6-3 and the channel member 7-3 are also configured to be identical in fixing positions where fixation with the screws is to be performed. Arranging the attachment position and the fixing positions to be identical between the blade member 6-3 and the channel member 7-3 in this manner makes it possible to freely interchange the blade member 6-3 and the channel member 7-3 and it is also possible to freely turn the channel member 7-3 upside down.

Figure 36:
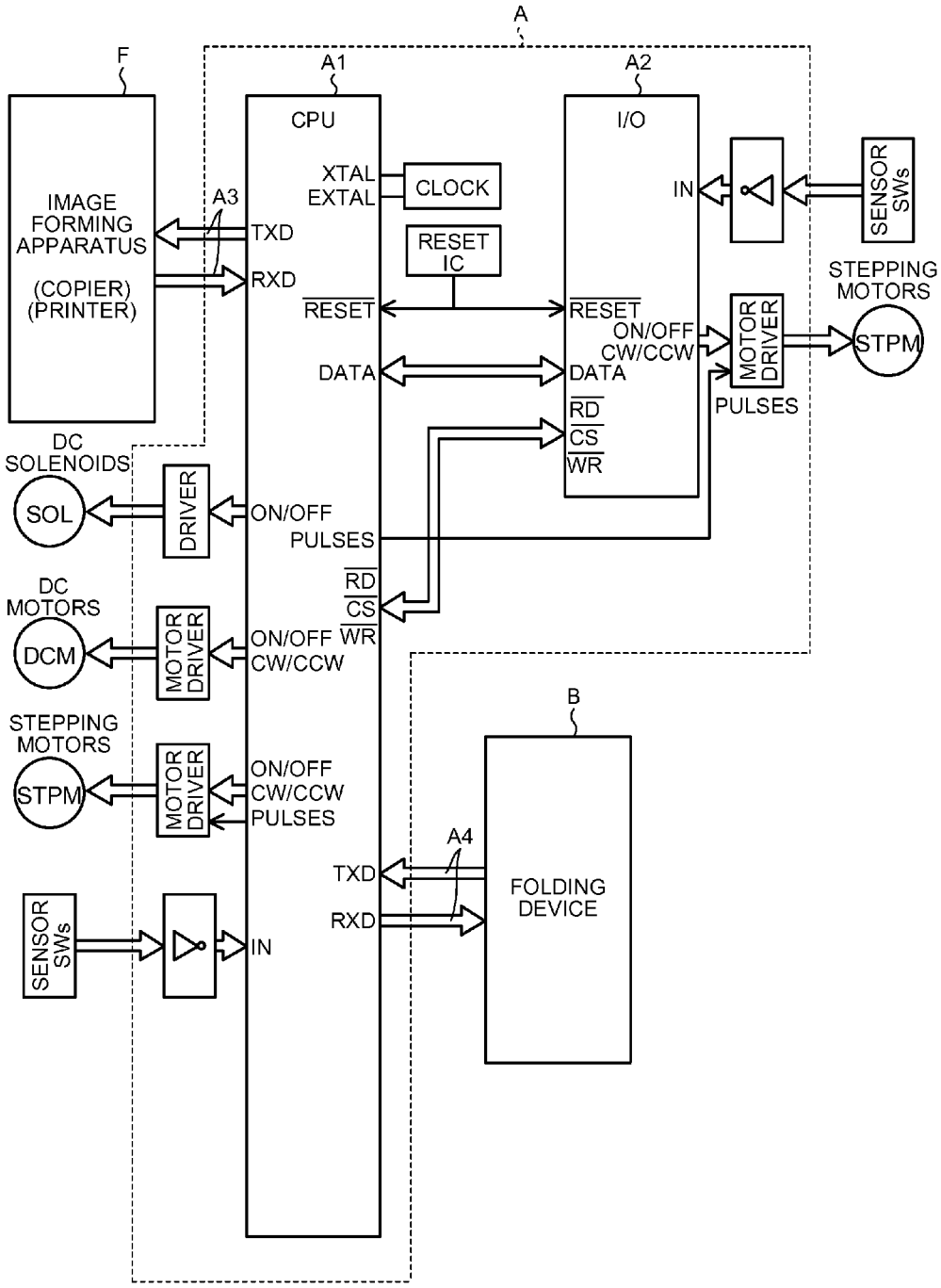
FIG. 36 is a block diagram illustrating a control structure of the image forming system including the creasing device, the folding device, and an image forming apparatus.

FIG. 36 is a block diagram illustrating a control structure of the image forming system including the creasing device A, the folding device B that performs folding, and the image forming apparatus F. The creasing device A includes a control circuit equipped with a microcomputer including a central processing unit (CPU) A1 and an input/output (I/O) interface A2. Various signals are fed to the CPU A1 via a communications interface A3 from the CPU, various switches on a control panel E1, and various sensors (not shown) of the image forming apparatus E. The CPU A1 performs predetermined control operations based on the fed signals. The CPU A1 also receives signals from the folding device B via a communications interface A4 and performs predetermined control operations based on the fed signal. The CPU A1 also performs drive control for a solenoid and a motor via a driver and a motor driver and obtains detection information from a sensor in the device via an interface. For some target to be controlled and sensor, the CPU A1 also performs drive control for a motor via motor drivers and obtains detection information from a sensor via the I/O interface A2. The CPU A1 performs the control operations described above by reading program codes stored in read only memory (ROM) not shown, deploying the program codes into random access memory (RAM) (not shown), and executing program instructions defined in the program codes by using the RAM as a working area and data buffer.

The creasing device A illustrated in FIG. 36 is controlled according to an instruction or information fed from a CPU of the image forming apparatus F. An operating instruction is input by a user at the control panel (not shown) of the image forming apparatus F. Accordingly, an operation signal input at the control panel is transmitted from the image forming apparatus F to the creasing device A and to the folding device B. Operation status and functions of the devices A and B are informed to a user via the control panel.

As described above, according to the present embodiment, advantageous effects including the following effects are obtained.

1) By dividing a member (the blade member 6-3) forming the creasing blade 6-1 (convex blade) from the blade-side receiving member 6-2 and dividing a member (the channel member 7-3) forming the creasing channel 7-1 (concave blade) from the channel-side receiving member 7-2, the blade member 6-3 and the channel member 7-3 can be manufactured independently from the blade-side receiving member 6-2 and the channel-side receiving member 7-2, respectively. This allows each of the blade member 6-3 and the channel member 7-3, manufacture of which is relatively difficult, to be formed into a linear shape, and an arcuate convex surface is only formed on each of the blade-side receiving members 6-2 and the channel-side receiving member 7-2, manufacture of which is relatively easy. This leads to substantial reduction of processing cost.

2) The arcuate creasing blade 6-1 and the creasing channel 7-1 corresponding to the arcuate creasing blade 6-1 can be easily obtained by attaching each of the blade member 6-3 and the channel member 7-3 to a corresponding one of the blade-side receiving members 6-2 and the channel-side receiving member 7-2.

3) Processing efficiency is also increased because the blade-side receiving members 6-2 for the creasing member 6 and the channel-side receiving member 7-2 for the receiving block 7 can be identical in shape.

4) The blade-side receiving members 6-2 for the creasing member 6 and the channel-side receiving member 7-2 for the receiving block 7 can be identical in shape so that the blade member 6-3 and the channel member 7-3 can be interchanged easily. This makes it possible to form a crease on both sides of a sheet and also makes it possible to easily change a face of a sheet toward which a crease is formed.

5) It is possible to easily change a crease size by changing shape or dimension of a channel shape of the creasing channel 7-1. This change can be made readily and in wide variety by selecting one from a plurality of channel members 7-3 that differ from one another in shape of the channel.

6) Related to 5), defining each of different channels, which differ from each other, for instance, in depth or shape, on one of both sides of the channel member 7-3 makes it possible to adapt to two types of creasing with the single channel member 7-3.

According to an embodiment of the present invention, it is possible to manufacture an arcuate blade, which enables formation of an even crease in a sheet, efficiently and less expensively.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing device creasing a sheet, the creasing device comprising:

a first member extending in a direction perpendicular to a direction, in which the sheet is conveyed, and including a creasing blade protruding from the first member;

a first receiving member including an attachment surface, to which the first member is configured to be attached;

a second member arranged to face the first member and including a first creasing channel on a first surface of the second member and a second creasing channel on a second surface of the second member opposite to the first surface, the first creasing channel configured to allow the creasing blade to be fitted thereinto with the sheet between the first creasing channel and the creasing blade, the second creasing channel configured to allow the creasing blade to be fitted thereinto with the sheet between the second creasing channel and the creasing blade;

a second receiving member including an attachment surface, to which the second member is configured to be attached; and a driving section configured to bring the first member and the second member into contact with each other and configured to separate the first member and the second member from one another to cause the sheet stopped at a predetermined position to be pinched between the first member and the second member and creased, wherein at least any one of the attachment surface of the first receiving member and the attachment surface of the second receiving member is arcuate, when the first member is attached to the attachment surface of the first receiving member and the second member is attached to the attachment surface of the second receiving member in a manner that the first member and the second member face each other, a blade edge of at least one of the creasing blade and the creasing channel has an arcuate shape convex toward one another, and the second member is configured to attach to the second receiving member so that one of the first creasing channel and the second creasing channel faces the creasing blade.

2. The creasing device according to claim 1, wherein the first receiving member and the second receiving member are identical in shape.

3. The creasing device according to claim 1, wherein the first member and the second member are configured to be changeable such that the first member is fixed to the second receiving member and the second member is fixed to the first receiving member.

4. An image forming system comprising:

a creasing device configured to crease a sheet; and an image forming apparatus configured to form an image on the sheet, the creasing device including, a first member extending in a direction perpendicular to a direction, in which the sheet is conveyed, and including a creasing blade protruding from the first member;

a first receiving member including an attachment surface, to which the first member is configured to be attached;

a second member arranged to face the first member and including a first creasing channel on a first surface of the second member and a second creasing channel on a second surface of the second member opposite to the first surface, the first creasing channel configured to allow the creasing blade to be fitted thereinto with the sheet between the first creasing channel and the creasing blade, the second creasing channel configured to allow the creasing blade to be fitted thereinto with the sheet between the second creasing channel and the creasing blade;

a second receiving member including an attachment surface, to which the second member is configured to be attached; and a driving section configured to bring the first member and the second member into contact with each other and configured to separate the first member and the second member from one another to cause the sheet stopped at a predetermined position to be pinched between the first member and the second member and creased, wherein at least any one of the attachment surface of the first receiving member and the attachment surface of the second receiving member is arcuate, when the first member is attached to the attachment surface of the first receiving member and the second member is attached to the attachment surface of the second receiving member in a manner that the first member and the second member face each other, a blade edge of at least one of the creasing blade and the creasing channel has an arcuate shape convex toward one another, and the second member is configured to attach to the second receiving member so that one of the first creasing channel and the second creasing channel faces the creasing blade.

* * * * *